US005518177A

United States Patent [19]

Weaver et al.

[11] Patent Number: 5,518,177

[45] Date of Patent: May 21, 1996

[54] COMPRESSED AIR HYDRANT HEATER DEVICE

[75] Inventors: Timothy J. Weaver, Great Valley, N.Y.; David Riley, Erie, Pa.; William B. Smith, Jr., Akron, Ohio; Donald Cutler, Warren, Pa.

[73] Assignee: Holimont Inc., Ellicottville, N.Y.

[21] Appl. No.: 257,196

[22] Filed: Jun. 9, 1994

[51] Int. Cl.[6] ..... E01H 4/00

[52] U.S. Cl. ..... 239/2.2; 239/14.2

[58] Field of Search ..... 239/14.2, 2.1; 392/482, 489, 480, 486

[56] References Cited

U.S. PATENT DOCUMENTS

| | | | |
|---|---|---|---|
| 1,197,061 | 9/1916 | Poole | 392/489 |
| 1,291,708 | 1/1919 | Anderson | 392/482 |
| 1,946,262 | 2/1934 | Adams | 392/489 X |
| 2,391,207 | 12/1945 | Van Shaack | 392/482 X |
| 4,919,331 | 4/1990 | Kosik et al. | 239/14.2 X |
| 5,379,937 | 1/1995 | Rothe | 239/14.2 |
| 5,400,966 | 3/1995 | Weaver et al. | 239/14.2 X |

FOREIGN PATENT DOCUMENTS

| | | | |
|---|---|---|---|
| 18554 | 11/1980 | European Pat. Off. | 392/484 |
| 2035287 | 1/1972 | Germany | 392/484 |
| 2804749 | 8/1979 | Germany | 392/482 |

*Primary Examiner*—Kevin P. Weldon

*Attorney, Agent, or Firm*—Hodgson, Russ, Andrews, Woods & Goodyear

[57] ABSTRACT

An improved snow making machine (10) is described, comprising a housing (14) and a nucleator (18) disposed inside the housing to mix compressed air with pressurized water to generate a wide angle round spray (24) pattern of ice crystal nuclei. An air hydrant heater device (12) is connected in the compressed air line (74) to heat the compressed air so that humidity present in the air will not freeze and render the nucleator inoperative at relatively low operating temperatures. A spray nozzle manifold (24) is mounted annularly around the housing discharge outlet (14A) and supports a plurality of water nozzles (28) that inject a cold water shower into the air flow, which water shower commingles with the ice crystal nuclei to thereby form ice granules as the two travel through the cold ambient air. The snow making machine can be mounted on a tower like support structure that provides for adjusting the discharge direction and tilt angle of the discharge outlet from a ground level elevation.

30 Claims, 3 Drawing Sheets

COMPRESSED AIR HYDRANT HEATER DEVICE

BACKGROUND OF THE INVENTION

1. Field of the Invention

The present invention relates to a method and machine for making artificial snow and more particularly to an improved method and heater devise useful with all kinds of snow making machines to prevent compressed air line freeze-up and thereby benefit making large quantities of high quality, granular snow.

All snow making machines are provided with a nucleator where compressed air mixes with pressurized water to form a spray of ice crystal nuclei. The heater devise of the present invention serves to pre-heat the compressed air entering the nucleator. One type of snow making machine useful with the present heater device provide an air flow generator disposed inside a housing of the machine to propel the spray of ice crystals leaving the nucleator through a water shower. The water shower is provided by a water injector that baths the ice crystals. As the water coated ice crystals travel through the ambient air, the water freezes to form ice granules. Another type of snow making machine is referred to as an air/water type. This machine does not have an air flow generator or a water injector. Instead, the compressed air and pressurized water are expelled out the nucleator propelled solely by their combined forces. This type of snow making machine requires large volumes of compressed air for proper functioning.

Regardless of the type of snow making machine used, the heater device of the present invention insures that the compressed air flows from the main air compressor through the compressed air hydrant and conduit system to reach the nucleator at a sufficiently warmed temperature so that any humidity present in the air will not freeze and render the compressed air system inoperative prior to the air mixing with the pressurized water in the nucleator. Thus, by heating the compressed air upstream from the nucleator, the air hydrant heater of the present invention benefits snow production in existing air systems for all types of snow making machines wherein the compressed air has a relatively high moisture content. This negates the need to dehumidify the compressed air or provide the compressed air with an anti-freeze additive to insure continued nucleator operation at any snow making temperature.

2. Prior Art

Preventing humidity from freezing in the compressed air system supplied to the nucleator of a snow making machine can be a troublesome and vexing problem. In any snow making machine, it is imperative that the compressed air line remain open and provide for sufficient flow volume to the nucleator where the compressed air mixes with pressurized water to form the spray of ice crystal nuclei expelled from the nucleator. It is this spray that travels through the freezing ambient atmosphere to form ice granules.

In a ski resort having multiple ski runs with a plurality of snow making machines positioned at strategic locations along the runs, each snow making machine, regardless of whether it is provided with an air flow generator and a water injector or if it is an air/water type, must be fed with pressurized water and compressed air. The compressed air is usually provided by a hose that connects to a main air hydrant supplied by a central air compressor. The compressed air can leave the compressor at temperatures approaching 200° F. In some cases, the compressed air is moved through an air cooler that lowers the air temperature to between about 60° F. to 80° F. Even at these cooled temperatures, air can hold a relatively large volume of humidity.

The main air hydrant leaving the compressor is often buried to a point where the air hoses feeding the respective snow making machine connects to the air hydrant. Thus, what additional air cooling that does take place between the compressor and the point where the air hydrant surfaces from below ground is usually not a problem. Air line freeze-up occurs, if at all, in the compressed air system between the point where the air hydrant surfaces and the nucleator, or between the air cooler and the nucleator, as the case may be, and especially along the length of the exposed portion of the air hydrant and compressed air hose connection. The reason for this is that these parts are usually made of heat conductive materials, such as metal to facilitate connecting the air hose to the air hydrant.

As previously mentioned, one technique that has been practiced extensively by the prior art is to flow the compressed air through an after cooler before the air is moved to the compressed air hydrant. This can be an extremely expensive solution which renders it impractical for the vast majority of ski resorts. Another technique practiced by the prior art has been to inject an antifreeze solution, such as methanol into the compressed air leaving the compressor. However, in addition to being expensive, this is dangerous. Still another prior art method used to prevent air line freeze-up is to periodically switch the hoses used as the compressed air hose and the pressurized water hose feeding off the respective air and water hydrants. That way, the pressurized water is used to blow any build up of frozen humidity out of the air line. The problem with this method is that it requires the constant attention of an operator and still does not solve the problem of humidity freezing in the air hydrant itself.

The air hydrant heater of the present invention thus provides an economical, reliable and easily operated device for preventing compressed air line freeze up in all types of snow making machines. In that respect, the present air hydrant heater preferably connects to the compressed air main and since both the air main and air hydrant heater are of a thermally conductive material, heat energy generated by the air hydrant heater is conducted to the air main to there warm the compressed air and help prevent freeze-up. Additionally, the air hydrant heater warms the air flowing therethrough to a sufficient degree so that what cooling that does take place downstream is not sufficient to freeze up the air line and the nucleator.

SUMMARY OF THE INVENTION

The present invention comprises a heater device for use in conjunction with a machine for making artificial snow, wherein the heater provides for pre-heating compressed air prior to the compressed air being conveyed to the snow making machine by a compressed air conduit, the heater comprising: a heater body having at least one compressed air passage fed by the conduit and leading to the snow making machine, and wherein there is at least one inlet into the heater body and adapted to house a heat-energy generator for inputting heat energy into the heater body, wherein the heater body serves to transfer the heat energy to the compressed air entering the compressed air passage to raise the compressed air temperature and thereby help prevent humidity in the compressed air from freezing.

Further, the present invention comprises a machine for making artificial snow, which comprises: a housing having an inlet opening and a discharge outlet provided along a longitudinal axis of the housing; a nucleator operatively associated with the housing and adapted to expel an atomized mixture of compressed air and water to thereby form a spray of ice crystal nuclei; and a heater provided for preheating the compressed air prior to mixing with the water in the nucleator, the heater joined to a conduit for the compressed air and comprising a heater body having at least one compressed air passage fed by the compressed air conduit and leading to the nucleator, and wherein there is at least one inlet into the heater body and adapted to house a heat-energy generator for inputting heat energy into the heater body, wherein the heater body serves to transfer the heat energy to the compressed air entering the compressed air passage to raise the compressed air temperature and thereby help prevent humidity in the compressed air from freezing prior to the compressed air being conveyed to the nucleator to there mix with the water and form the spray of ice crystal nuclei.

Thus, the in-line heater device of the present invention pre-heats the compressed air before the air enters the nucleator and mixes with incoming pressurized water to be expelled from the nucleator as a spray of ice crystal nuclei. At relatively low temperatures, this pre-heating step insures that humidity in the compressed air does not condense and freeze either the compressed air line or the nucleator prior to mixing with the pressurized water.

These and other benefits of the present invention will become increasingly more apparent to those skilled in the art by reference to the drawings and the following description.

IN THE DRAWINGS

FIG. 1 is a schematic view of the snow making machine 10 of the present invention discharging artificial snow 42 to cover a ski slope 40.

FIG. 2 is a partial side view of the snow making machine 10 with a portion of housing 14 removed.

FIG. 3 is a broken side elevational view, partly in cross-section, of a compressed air hydrant heater 12 of the present invention connected between an air hose 74 and a main air hydrant 92.

DETAILED DESCRIPTION

Figure 1:
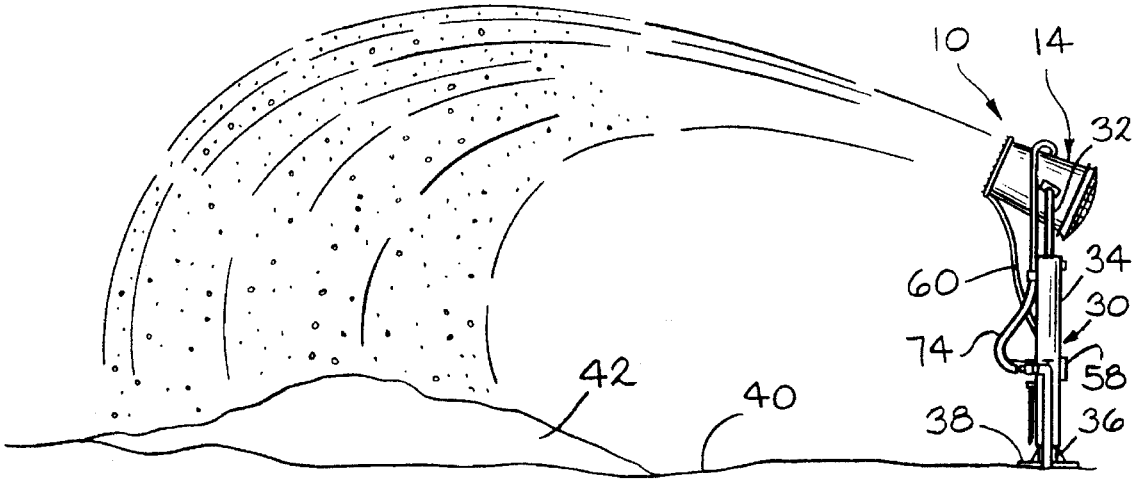
Figure 2:
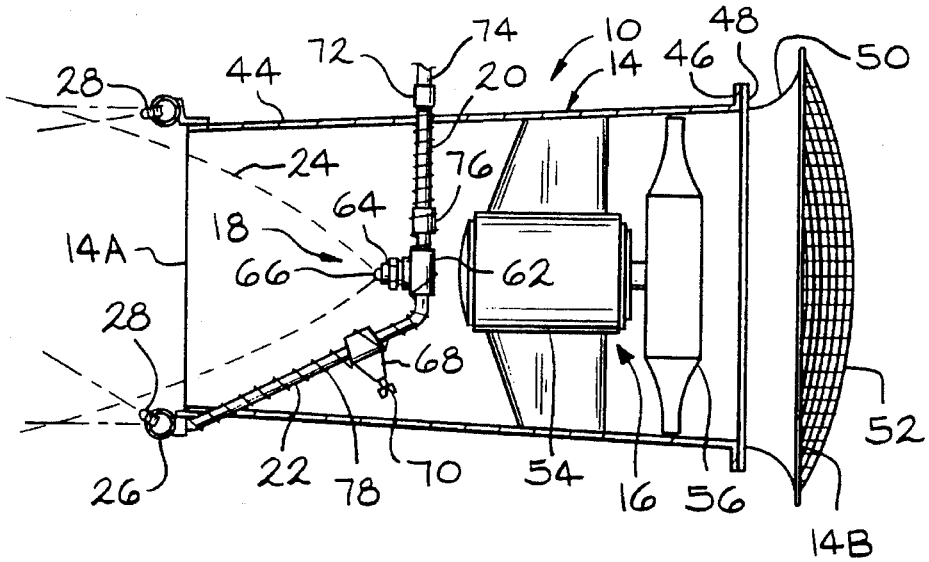

Referring now to the drawings, FIGS. 1 and 2 show a representative snow making machine 10 that is useful with the compressed air hydrant heater 12 (FIGS. 3 to 6) of the present invention. In other words, it should be understood that the snow making machine 10 is merely an illustration of one type of snow machine with which the compressed air hydrant heater 12 of the present invention can be associated, and snow machine 10 should in no way be seen as limiting.

Snow making machine 10 comprises a housing 14 having a circular cross-section along and around a longitudinal axis of the housing 14 providing an enclosure for a fan unit 16 and a downstream nucleator 18 that serves to mix pressurized air from air line 20 and pressurized water from water line 22 to form a spray 24 of ice crystal nuclei, as will hereinafter be explained in detail. An annularly shaped spray nozzle manifold 26 is provided circumferentially around the discharge outlet 14A of housing 14. Manifold 26 supports a plurality of water nozzles 28 that provide for bathing the spray 24 of ice crystal nuclei expelled through the discharge outlet 14A to thereby form artificial snow as the water covered ice crystal nuclei travel through the freezing ambient atmosphere. This will hereinafter be explained in detail.

Housing 14 is pivotally and rotatably mounted to a support 30 to adjust both the tilt angle and the direction of discharge of housing 14. Support 30 comprises a yoke 32 mounted on an open ended cylinder 34 in coaxial and rotatable relationship with a post 36. The lower end of post 36 is mounted to a horizontal plate 38 by any suitable means such as welding and the like, and plate 38 is in turn bolted or otherwise secured to a concrete foundation block (not shown) buried adjacent to a section of a ski slope 40 and the like intended to be covered by artificial snow 42 made by the snow making machine 10. Preferably, the post 36, yoke 32 and associated snow making machine 10 are rotatable 360 degrees about the axis of post 36 to aim the snow making machine in a desired direction for covering a particular section of the ski slope 40 with the artificial snow 42. Preferably, the range of the tilt angle adjustment is between about +50 degrees above a horizontal plane to about −20 degrees below the horizontal. For a more detailed description of the structure provided for adjusting both the direction of discharge and the tilt angle of the housing 14, reference is made to U.S. Pat. No. 5,400,966, for a Machine For Making Artificial Snow And Method, which is assigned to the assignee of the present invention and incorporated herein by reference.

Although the support 30 is shown as a tower in FIG. 1, it is contemplated by the scope of the present invention that the snow making machine 10 can also be mounted on a portable support means (not shown) that can be moved from one location to another as needed. This is well known to those skilled in the art.

Referring now to the snow making machine 10 shown in FIG. 2, housing 14 has the fan unit 16 and the nucleator 18 disposed therein to provide for forming and propelling the spray 24 of ice crystal nuclei out through the discharge opening 14A of housing 14, as will be presently described in detail. Housing 14 has a frusto-conical section 44 having a first, larger diameter with a planar annular flange 46 attached by bolts (not shown) or other suitable means to the peripheral extent of flange 48 of a rear intake section 50, wherein the frusto-conical section 44 tapers downwardly and inwardly toward the longitudinal axis and a second, smaller diameter providing the discharge outlet 14A. The inlet opening 14B of the intake section 50 of housing 14 is preferably covered by a coarse mesh screen 52 to minimize the likelihood of injury to the operator and also to prevent leaves, twigs, and other like debris from being drawn into the machine.

Fan unit 16 comprises an electric motor 54 driving a fan blade 56 having an array of radial blades rotatable about the longitudinal axis of the housing 14 to produce a substantially unidirectional air flow exiting the discharge outlet 14A. An electrical breaker box 58 (FIG. 1), connected to a power supply cable (not shown) tapped into an electrical power supply (not shown), is mounted on cylinder 34 of support 30. Box 58 is provided with controls for turning on and off electrical power to the electric motor 54 to thereby power the fan unit 16. Box 58 is provided at a height that the operator can readily reach to energize and de-energize the electrical supply to the snow making machine 10 from ground level.

As particularly shown in FIG. 2, mounted adjacent to the periphery of the discharge outlet 14A of housing 14 provided by the second diameter of the frusto-conical section 44, is the annularly shaped spray nozzle manifold 26 having the plurality of water nozzles 28 threadingly recessed into the manifold 26. The water nozzles 28 are preferably 45 to 60 degrees full cone, spiral nozzles of a well known commercially available type that can, for example, be acquired from Spray Systems, Inc., as their HH series.

As shown in FIG. 1, spray nozzle manifold 26 is supplied by a main water hose 60 connected to an external water supply (not shown). When the water pumping system (not shown) is actuated, water is fed directly to the manifold 26 to supply water to the nozzles 28 which direct a water shower into the air flow exiting the discharge outlet 14A of housing 14. The precise number of water nozzles 28 is not critical so long as the quantity of bulk water droplets, for example in gallons per minute (GPM), is able to be transported by the generated air flow and deposited a sufficient distance from the snow making machine 10 with adequate hang time to freeze the water droplets. In addition to being dependent on the velocity of the generated air flow, sufficient freezing of the bulk water droplets through the ambient atmosphere relies on the temperature and relative humidity of the ambient atmosphere.

As shown in FIG. 1, the nucleator 18 is mounted inside housing 14 along the longitudinal axis thereof and at a position directly adjacent to and downstream from fan unit 16. Nucleator 18 comprises housing 62 leading to an expansion chamber 64 having a dome shaped head 66 provided with a plurality of openings (not shown) in communication with the inside of housing 62. Nucleator housing 62 is fed from opposite sides by the compressed air line 20 and the pressurized water line 22 wherein the compressed air and pressurized water then move in an axial direction through housing 62 to converge and unite in the expansion chamber 64. There, the compressed air expands and cools to below the freezing temperature so that the two fluids are expelled out through the openings in the nucleator head 66 as the atomized spray 24 that forms into ice crystal nuclei by the mime the spray 24 has travelled from nucleator 18 to the discharge outlet 14A of housing 14. The ratio of compressed air to water mixed in nucleator 18 can vary from about 22:1 to 50:1, and preferably about 37:1 to 45:1. Preferably, nucleator water feed line 22 is tapped directly into spray nozzle manifold 26 so that water line 22 provides water to nucleator 18 whenever the water nozzles 28 are being supplied with water.

Nucleator water line 22 is provided with an in-line water pressure regulator 68 having a pressure adjustment screw 70. An opening (not shown) is provided in the frusto-conical section 44 of housing 14 directly below regulator 68. This enables an operator to pre-adjust the water pressure leaving regulator 68 by turning screw 70. Regulator 68 enables water pressure to be adjusted between a range of about 30 psi to about 90 psi, the pressure being preselected according to local ambient temperatures, humidity conditions and air and water pressures.

As shown in FIG. 2, air line 20 connects to nucleator housing 62 at a position directly opposite water line 22 and leads to a fitting 72 that joins to an air hose 74 (FIGS. 1 and 2) supplied with compressed air from an external pressurized air source (not shown). Air line 20 is provided with an in-line one-way check valve 76 that prevents water back feed into the air line 20 from nucleator 18.

A spirally wound external heating coil 78 is provided wrapped around the water line 22 beginning at the spray nozzle manifold 26 and extending along the length of water line 22, around and over the regulator 68, nucleator housing 62 and over and around the air line 20 including the check valve 76. External heating coil 78 is provided with power from the electrical breaker box 58 and serves to warm water line 22, nucleator 18, air line 20 and check valve 76 to prevent freezing or to thaw out frozen components.

As the compressed air enters the expansion chamber 64, the air expands and cools. It is, therefore, imperative that the air be warmed so that the expansion derived cooling in nucleator 18 and particularly expansion chamber 64 does not effect such low air temperatures as to cause a sufficient quantity of humidity in the compressed air to precipitate out and freeze-up in the nucleator 18. Preferably, the temperature of the compressed air has been warned to about 34° F. before the air enters nucleator housing 62.

Figure 3:
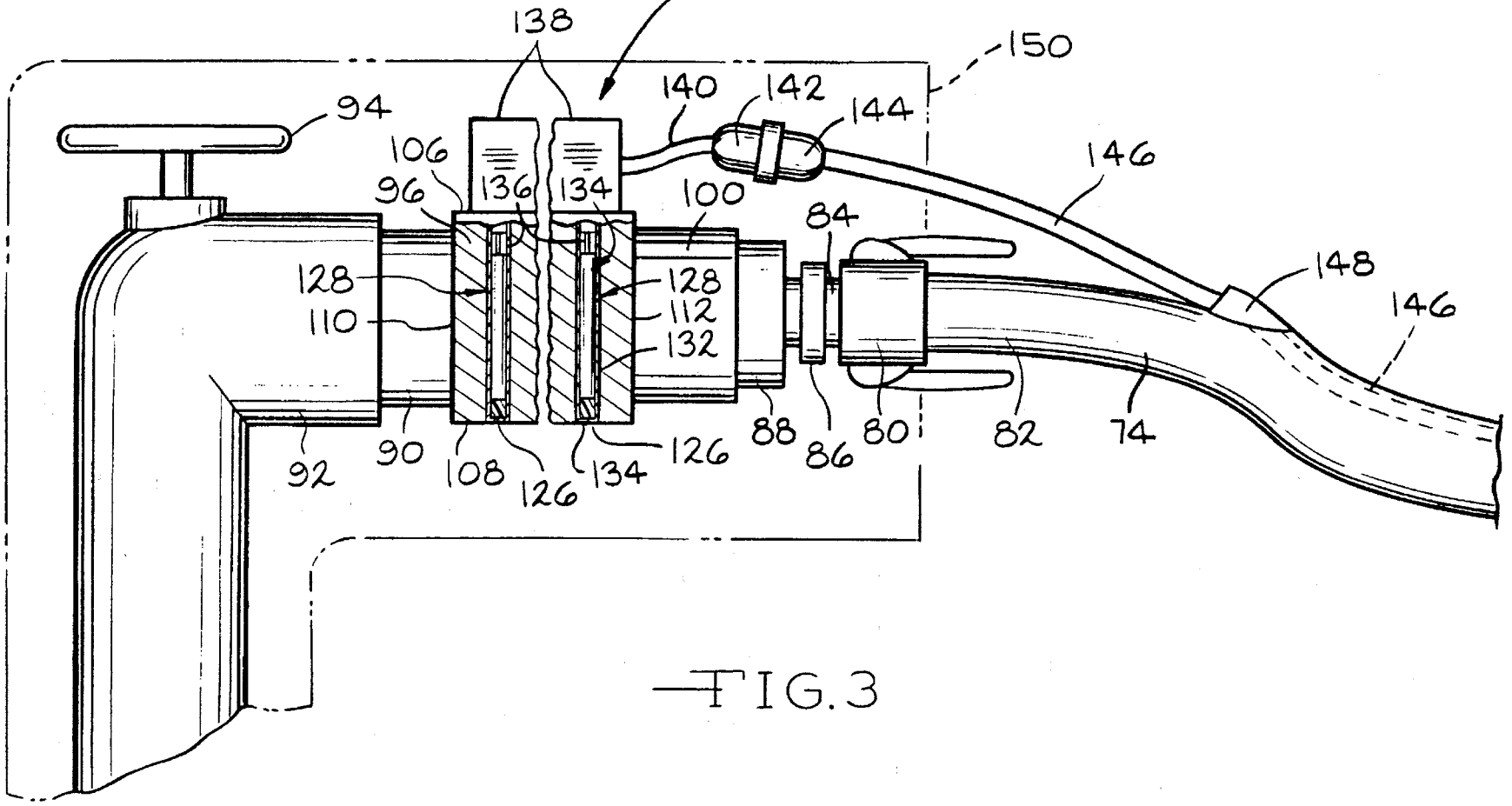

FIG. 3 is a broken side elevational view of the air hydrant heater 12 of the present invention shown partly in cross-section. The compressed air entering expansion chamber 64 is heated by air hydrant heater 12 connected in line with the compressed air hose 74. Air hose 74 is preferably insulated to help prevent unnecessary cooling of the compressed air moving therethrough and has a quick-disconnect coupling 80 at its upstream end 82 that provides for connecting air hose 74 to fitting 84. Fitting 84 is joined to a union 86 that in turn is connected to an adapter 88 connected to the compressed air hydrant heater 12 of the present invention leading from a fitting 90 and a main compressed air hydrant 92 regulated by valve 94. Air hydrant 92 feeds from a compressed air supply, which is not shown. It should be understood that fitting 84, union 86, adapter 88, the compressed air hydrant heater 12, fitting 90 and air hydrant 92 are all made of a thermally conductive material such as aluminum and the like.

While not limiting the scope of the present invention, air hydrant heater 12 is approximately 6 inches in length or longer to provide a sufficient surface area for heating the compressed air flowing therethrough. Compressed air hydrant heater 12 is shown in greater detail in FIGS. 4 to 6, and comprises a central body portion 96 intermediate a first 98 and a second 100 cylindrically-shaped ends. The central body portion 96 has a generally square shape as shown oriented with respect to FIGS. 4 to 6 and includes right and left side walls 102 and 104 that extend to and meet with upper and lower walls 106 and 108 joined to first and second end walls 110 and 112. The first cylindrical end 98 extends outwardly from a central location in first end wall 110 and is provided with exterior threads 114 that mate with internal threads (not shown) provided in the fitting 90 joined to the distal open end of air hydrant 92 to thereby connect the air hydrant heater 12 to the main air hydrant 92. The second, downstream end 100 of air hydrant heater 12 is internally threaded (shown in dashed lines in FIGS. 4 to 6) to threadingly connect to the adapter 88 leading to air hose 74.

The intermediate central body portion 96 of the air hydrant heater 12 has a plurality of conduit passages 116 that communicate between a first face (not shown adjacent to and surrounded by the first cylindrical end 98 and a second face 118 (FIG. 6) disposed adjacent to and surrounded by the second cylindrical end 100 to thereby conduct pressurized air between the faces. The first and second faces of the central body portion 96 are preferably planar and parallel with respect to each other and aligned normal to the longitudinal axis of the air hydrant heater 12.

Figure 4:
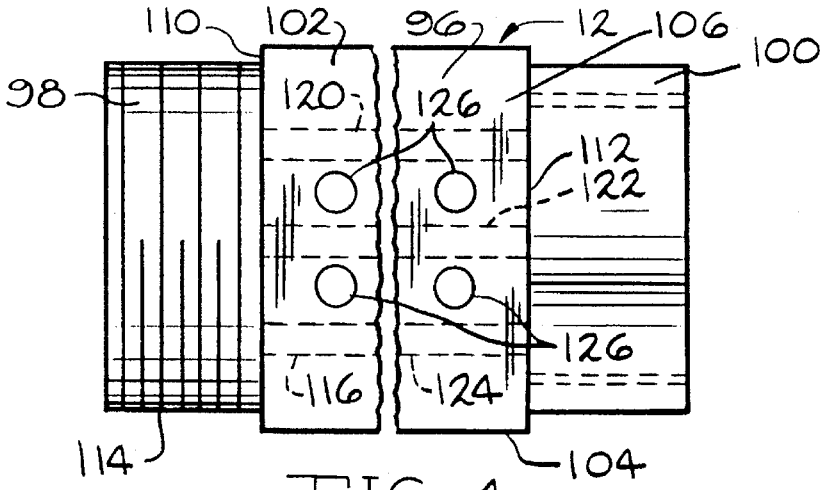
FIG. 4 is a broken plan view of the compressed air hydrant heater 12 with the compressed air passages 116 shown in dashed lines.
Figure 5:
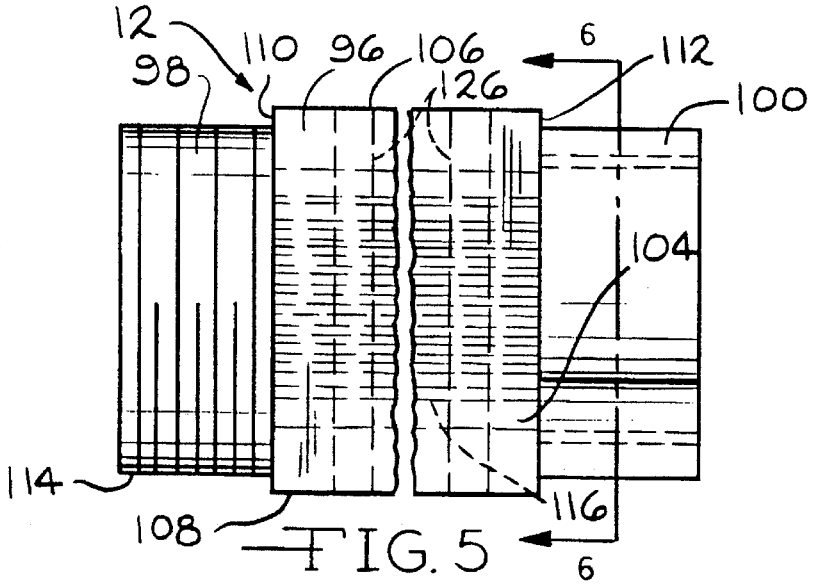
FIG. 5 is a broken side elevational view of the compressed air hydrant heater 12 shown in FIG. 4.
Figure 6:
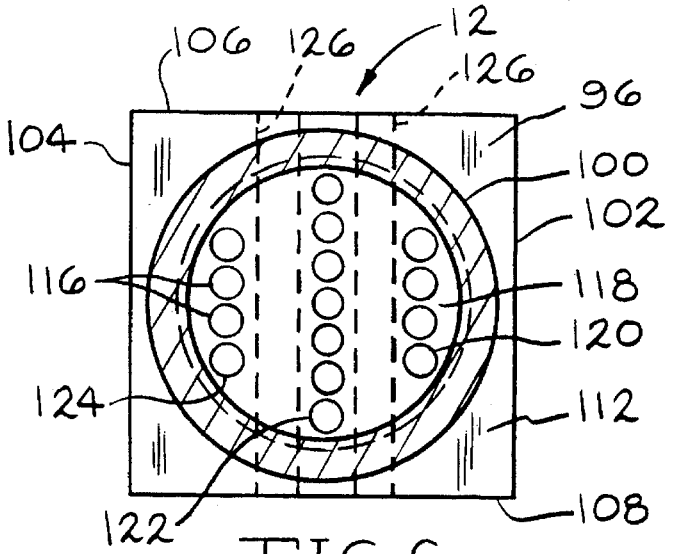
FIG. 6 is a cross-sectional view along line 6—6 of FIG. 5.

As clearly shown in FIGS. 4 and 6, the compressed air passages 116 are preferably arranged in three spaced apart columns 120, 122 and 124. Right column 120 is provided with four passages 116, the middle column 122 is provided with seven passages 116, and the left column 124 is provided with four passages 116. The plurality of passageways comprising the columns 120, 122 and 124 each preferably have a constant circular shape extending along and around the longitudinal axis of the respective passages. Furthermore, the longitudinal axis of the passages in the respective columns are aligned along vertical planes which are parallel. The precise number of passages 116 in each column is not critical to the present invention so long as the volume air flow therethrough is sufficient for proper operation of nucleator 18 and there is ample surface area for sufficient heat-energy conduction to the air flow, as will be explained in detail presently.

As clearly shown in FIGS. 3, 4 and 6, disposed between and isolated from the spaced apart columns 120, 122 and 124 of passages 116 are two pairs of cross-passages 126. The cross-passages 126 are shown in dashed lines in FIGS. 5 and 6, with one pair disposed between the right and intermediate columns 120 and 122 of compressed air passages and the other pair disposed between the intermediate and left columns 122 and 124. The cross-passages 126 communicate between the upper and lower walls 106 and 108 and they have a constant circular shape extending along and around the longitudinal axis of the respective cross-passages 126. The longitudinal axes of the two pairs of cross-passages 126 are aligned along vertical planes which are parallel.

As shown in cross-section in FIG. 3, the cross-passages 126 are adapted to house electrical heater cartridges 128. Each cross-passage 126 receives one heater cartridge 128, and each heater cartridge 128 comprises a heater element 130 housed inside a tube 132 made of a heat conductive material, such as stainless steel and the like. An insulator material 134 is provided inside the tube 132 proximate both ends thereof to prevent water and the like from shorting out or otherwise rendering the heater element 130 inoperative. An electrical lead 136 for the heater element 130 extends outwardly from a proximal end of the tube 132 having a sufficient length to connect to an electrical junction box 138 suitably mounted on the upper wall 106 of the intermediate central body portion 96 of the air hydrant heater 12.

As shown in side elevational view in FIG. 3, an electrical conductor 140 for the plurality of electrical leads 136 of the electrical heater cartridges 128 extends from junction box 138 and is provided with a connector 142 at its distal end thereof. Connector 142 mates with a suitable connector 144 provided at the end of a main electrical conductor 146 which is housed inside air hose 74 for a majority of its length and exits hose 74 at seal 148 adjacent to coupling 80 to connect to conductor 140. Main conductor 146 leads to the breaker box 58 (FIG. 1) to thereby provide for energizing the heater cartridges 128 housed in the intermediate central body portion 96 of the air hydrant heater 12 when electrical power is provided to activate the other electrically powered components of the snow making machine, such as the fan unit 16 and the heater coil 78. The heater cartridges 128 are of a commercially available type, such as can be acquired from Watlow Electric, St. Louis, Mo., as part no. E3AX569A.

When electrical power is fed to the heater cartridges 128 to thereby energize them, the heater cartridges 128 raise the temperature of the air hydrant heater 12 through resistance heating. Since the air hydrant heater 12 is made of a thermally conductive material, the heat generated by heater cartridges 128 is conducted to the wall of the passages 116 which is then transferred by convection heating to raise the temperatures of the air flow through the passages 116. The fittings 84 and 90, union 86, adapter 88 and main air hydrant 92 are all made of a thermally conductive material so that some of the heat energy generated by the heater cartridges 128 is conducted to these components and to aid in warming the compressed air both before and after the compressed air moves through the air hydrant heater 12 of the present invention.

In that respect, the compressed air will typically enter the main air hydrant 92 from the compressed air supply (not shown) at about 34° F. As the compressed air moves through the air hydrant heater 12 and associated fittings, the air temperature is raised to between about 65° F. to 75° F. Then, as the compressed air moves through the air hose 74 to the air line 20 there will occur some degree of cooling depending on the ambient temperature, the length of the air hose 74 and its volume of air flow. Preferably, the compressed air moving through the air hydrant heater 12 is warmed to an extent that the subsequent cooling in air hose 74 enables the compressed air to have a sufficiently warmed temperature to retard humidity in the compressed air from precipitating out and freezing the air main 92 and air hose 74 before entering the nucleator 18 and there mixing with the pressurized water in expansion chamber 64. Then, the compressed air expands and cools to below the freezing temperature so that the two fluids are expelled out through the openings in the nucleator head 66 as the atomized spray 24 that forms into ice crystal nuclei by the time the spray 24 has travelled from nucleator 18 to the discharge outlet 14A of housing 14.

As further protection against freezing of the compressed air system, the air hydrant 92, air hydrant heater 12 of the present invention and associated fittings are wrapped in an insulated housing indicated by the dashed line 150 in FIG. 3. This is well known to those skilled in the art.

As shown in FIG. 1, nucleator 18 is positioned inside the frusto-conical section 44 of housing 14, aligned along the longitudinal axis thereof, and fed by air line 20 and water line 22. The atomized air/water mixture leaving nucleator 18 thus is able to freeze into the spray 24 of ice crystal nuclei that propagates in a wide angle round pattern diverging radially along and around the longitudinal axis of housing 14 towards the discharge outlet 14A to completely fill the area of the discharge outlet 14A without impinging on the inside wall of the frusto-conical section 44, thereby preventing ice build-up on the inside of housing 14. The frusto-conical section 44 has about a 5 degree taper with respect to the longitudinal axis and serves to equilibrate the internal cross-sectional area normal to the axis of housing 14 to provide a substantially similar area along a plane through the electric motor 54 as at the discharge outlet 14A. This helps maintain substantially the same air flow velocity leaving the discharge outlet 14A as is established upstream at the outlet side of the fan blade 56 of the fan unit 16. That way, substantially the total energy output from the fan unit 16 is efficiently used to propel and expel the wide angle round spray 24 pattern of ice crystal nuclei generated by nucleator 18 out through the discharge outlet 14A to throw the ice crystals 21 a substantial distance from tie snow making machine 10.

IN USE

With the discharge outlet 14A of housing 14 positioned at a desired direction and at a desired tilt angle, the electrical breaker box 58 is actuated to energize the electrical motor 54 of fan unit 16 which drives the fan blades 56 to produce a high volume air flow through the frusto-conical section 44 of housing 14 and exiting the discharge outlet 14A. The external pressurized air source (not shown) is then actuated to move pressurized air from the main air hydrant 92 through the air hydrant heater 12 of the present invention, then into the external air hose 74 and the air line 20 to feed pressurized air to the nucleator 18.

In an actual field experiment conducted at an ambient temperature of 29° F., the compressed air moving through the main air hydrant 92 initially had a temperature of about 34° F. The heater cartridges 128 were supplied with electrical power. Heat energy conducted from the air hydrant heater 12 through fitting 90 and into the distal portion of the air hydrant 92 adjacent to valve 94 raised the temperature of the compressed air to about 51° F. entering the first face of the air hydrant heater 12. This temperature is sufficient to prevent humidity in the compressed air from precipitating out and freezing the air hydrant 92. The compressed air moving through the three columns 120, 122 and 124 of passages 116 provided in the central body portion 96 was heated to about 69° F. before moving through the conductively warmed adapter 88, union 86 and fitting 84. The amount of cooling of the compressed air that occurs between coupling 80 and the nucleator 18 is a function of the length of the hose 74 and the ambient temperature. In this field experiment using the tower mounted snow making machine 10 previously described, the compressed air had cooled to about 34° F. by the time the compressed air entered the nucleator housing 62. This temperature ensured that any humidity in the compressed air did not freeze in the various fittings downstream from the air hydrant heater 12 and in the air hose 74 before entering the nucleator 18.

Actuating the electrical breaker box 58 also energizes the external heating coil 78 (FIG. 2) to warm the water line 22 and regulator 78, nucleator housing 62 and mixing chamber 64 and air line 20.

Finally, the water pumping system (not shown) is actuated to supply water to the water manifold 26 via the main water hose 60. Water manifold 26 automatically supplies high pressure water at a pressure of between about 150 psi to about 450 psi to the water nozzles 28 mounted therein. In turn, manifold 26 supplies water to water line 22 leading to nucleator 18. Thus, when the water nozzles 28 are provided with water, water is also supplied to the housing 62 of nucleator 18 with adjustable pressure regulator 68 cutting back on the water pressure to provide water at a pressure range of between about 30 psi to 90 psi, and preferably about 64 psi. Housing 62 serves to feed this water into mixing chamber 64 where the water mixes with high pressure heated air fed into housing 62 from the air hydrant heater 12 via air hose 74 and air line 20 to form the atomized air and water spray 24 exiting the dome shaped mixing chamber head of nucleator 18 in a wide angle round pattern. This atomized spray is propelled by the air flow from fan unit 16 in a diverging pattern that freezes into a spray 24 of ice crystal nuclei that fills the circular cross-section of the discharge outlet 14A without impinging on the inside surface of housing 14. In that respect, since the diverging pattern of ice crystal nuclei does not impinge on housing 14, there is no problem with ice build-up reducing the volume air flow exiting the discharge outlet 14A.

As the wide angle round spray 24 of ice crystal nuclei moves through and out the discharge outlet 14A, the ice crystal nuclei commingle with the bulk water droplets injected into the air flow by the water nozzles 28. The water droplets then begin to cool through convection and evaporation with the ice crystals serving as seed nuclei to which the cooled water droplets attach and through further cooling freeze into ice granules. As shown in FIG. 1, the ice granules are thrown in an arcing trajectory to thereby cover a portion of the ski slope 48 with artificial snow 50.

While this invention has been particularly described in connection with a preferred embodiments thereof, it is to be understood that this embodiment is by way of illustration and not limitation, and the scope of the appended claims should be construed as broadly as the prior art will permit.

What is claimed is:

1. A system for making artificial snow which comprises:

a) a snow making machine comprising:

i) a machine housing having an inlet opening and a discharge outlet; and ii) a nucleator operatively associated with the machine housing and adapted to expel an atomized mixture of compressed air and water to thereby form a spray of ice crystal nuclei;

b) a compressed air conduit leading to the nucleator of the snow making machine, the compressed air conduit having a portion disposed outside the confines of the machine housing and exposed to an ambient atmosphere; and c) a heater body associated with the compressed air conduit in the outside conduit portion thereof, wherein the heater body has at least one compressed air passage fed by the compressed air conduit upstream from the nucleator of the Snow making machine, and wherein there is at least one opening into the heater body that receives a heat-energy generator for inputting heat energy into the heater body, and wherein the heater body serves to transfer heat energy directly to the compressed air moving through the compressed air passage in the heater body to raise the temperature of the compressed air to an increased temperature sufficient to minimize precipitation of water vapor from the compressed air moving through the outside conduit portion to thereby minimize freezing in the compressed air conduit including the outside conduit portion prior to the compressed air being delivered to the nucleator of the snow making machine to there mix with the water and form the spray of ice crystal nuclei and wherein the heater body is associated with the outside conduit portion at an upstream position with respect to the machine housing such that the freezing in the compressed air conduit including the outside conduit portion is prevented due to the increased temperature of the compressed air heated while moving through the heater body and not from the application of heat energy directed to the nucleator of the snow making machine by conduction of said heat energy through the compressed air conduit itself.

2. The machine for making artificial snow of claim 1 wherein the compressed air conduit is in fluid flow communication with a compressed air source comprising a compressed air hydrant and wherein the compressed air conduit is a thermally conductive material so that a portion of the heat energy generated by the heat-energy generator is conducted to the compressed air hydrant to help minimize precipitation of water vapor from the compressed air moving from the source and through the compressed air hydrant and thereby minimize freezing.

3. The machine for making artificial snow of claim 1 wherein the heater body is a thermally conductive material.

4. The machine for making artificial snow of claim 1 wherein the opening into the heater body is segregated from the compressed air passage.

5. The machine for making artificial snow of claim 1 wherein the opening into the heater body is adapted to receive a resistor as the heat-energy generator.

6. The machine for making artificial snow of claim 1 wherein the heater body has a plurality of compressed air passages fed by the compressed air conduit and leading to the nucleator, and wherein the heat-energy generator is disposed at an intermediate position between at least two of the compressed air passages and segregated therefrom.

7. The machine for making artificial snow of claim 1 wherein there are a plurality of compressed air passages, each passage having a first longitudinal axis, and wherein the compressed air passages are disposed in columns in the heater body with the first longitudinal axes in each column aligned along a plane, there being at least two columns of compressed air passages with the planes of the first longitudinal axes in each column being coplanar.

8. The machine for making artificial snow of claim 7 wherein the opening that receives the heat-energy generator has a second longitudinal axis aligned normal to the planes of the columns of the compressed air passages.

9. The machine for making artificial snow of claim 7 wherein the compressed air passages each have a circular shape along and around their respective first longitudinal axes.

10. The machine for making artificial snow of claim 7 wherein the opening that receives the heat-energy generator has a circular shape along and around a second longitudinal axis.

11. The machine for making artificial snow of claim 7 wherein the plurality of compressed air passages are aligned in three columns and wherein there are a plurality of openings that receive heat-energy generators aligned in at least two second columns, each second column disposed intermediate the columns of the compressed air passages.

12. The machine for making artificial snow of claim 1 wherein the nucleator is disposed inside the machine housing at a position spaced upstream from the discharge outlet.

13. A method for making artificial snow, comprising the steps of:

a) providing a snow making machine comprising: a nucleator operatively associated with a machine housing, wherein the machine housing has an inlet opening and a discharge outlet and wherein the nucleator expels an atomized mixture of compressed air and water to thereby form a spray of ice crystal nuclei exiting the discharge outlet;

b) transmitting the compressed air to the nucleator of the snow making machine through a compressed air conduit, the compressed air conduit having a portion disposed outside the confines of the machine housing and exposed to an ambient atmosphere; and c) pre-heating the compressed air prior to mixing with the water in the nucleator, the pre-heating provided by a heater body associated with the outside conduit portion thereof, the heater body having at least one compressed air passage fed by the compressed air conduit upstream from the nucleator of the snow making machine, and wherein the heater body has at least one opening receiving a heat-energy generator inputting heat energy into the heater body, and wherein during the pre-heating step, heat energy is transferred directly from the heater body to the compressed air moving through the compressed air passage in the heater body to raise the temperature Of the compressed air to an increased temperature sufficient to minimize precipitation of water vapor from the compressed air moving through the outside conduit portion thereby minimizing freezing in the compressed air conduit including the outside conduit portion prior to delivering the compressed air to the nucleator of the snow making machine and there mixing with the water to form the spray of ice crystal nuclei and wherein the heater body is associated with the outside conduit portion at an upstream position with respect to the machine housing such that the freezing is prevented due to the increased temperature of the compressed air heated while moving through the heater body and not from the application of heat energy directed to the nucleator of the snow making machine by conduction of said heat energy through the compressed air conduit itself.

14. The method for making artificial snow of claim 13 wherein the compressed air conduit is in fluid flow communication with a compressed air source comprising a compressed air hydrant and wherein the compressed air conduit is a thermally conductive material and conducting a portion of the heat energy generated by the heat-energy generator to the compressed air hydrant, thereby minimizing precipitation of water vapor from the compressed air moving from the source and through the compressed air hydrant and thereby minimize freezing.

15. The method for making artificial snow of claim 13 including providing the heater body of a thermally conductive material.

16. The method for making artificial snow of claim 13 further including segregating the opening into the heater body from the compressed air passage.

17. The method for making artificial snow of claim 13 including providing a resistor as the heat-energy generator received in the opening into the heater body.

18. The method for making artificial snow of claim 13 including providing a plurality of compressed air passages fed by the compressed air conduit and leading to the nucleator, and further providing the heat-energy generator disposed at an intermediate position between at least two of the compressed air passages and segregated therefrom.

19. The method for making artificial snow of claim 13 further including providing a plurality of compressed air passages, each passage having a first longitudinal axis and wherein the compressed air passages are disposed in columns in the heater body with the first longitudinal axes in each column aligned along a plane, there being at least two columns of compressed air passages with the planes of the first longitudinal axes in each column being coplanar.

20. The method for making artificial snow of claim 19 further including providing the opening for the heat-energy generator extending into the heater body along a second longitudinal axis aligned normal to the planes of the columns of compressed air passages.

21. The method for making artificial snow of claim 19 including providing the compressed air passages each having a circular shape along and around their respective first longitudinal axes.

22. The method for making artificial snow of claim 19 including providing the opening in the heater body receiving the heat-energy generator having a circular shape along and around a second longitudinal axis.

23. The method for making artificial snow of claim 19 further including aligning the plurality of compressed air passages in three columns having the planes of their respective longitudinal axes coplanar and providing a plurality of openings into the heater body receiving the heat-energy generators aligned in at least two second columns, each second column disposed intermediate the columns of the compressed air passages.

24. The method for making artificial snow of claim 13 further including providing the nucleator disposed inside the machine housing at a position spaced upstream from the discharge outlet thereof.

25. In a system for making artificial snow comprising a snow making machine, the snow making machine comprising a machine housing having an inlet opening and a discharge outlet; a nucleator operatively associated with the machine housing to expel an atomized mixture of compressed air and water to thereby form a spray of ice crystal nuclei; and a conduit for the compressed air, the compressed air conduit having a portion disposed outside the confines of the machine housing the improvement comprising:

a heater associated with the compressed air conduit in the outside conduit portion thereof and provided for preheating the compressed air prior to mixing with the water in the nucleator of the snow making machine, the heater having a body with at least one compressed air passage fed by the compressed air conduit upstream from the outside conduit portion leading to the nucleator of the Snow making machine, and wherein there is at least one opening into the heater body that receives a heat-energy generator for inputting heat energy into the heater body, and wherein the heater body serves to transfer heat energy directly to the compressed air moving through the compressed air passage in the heater body to raise the temperature of the compressed air to an increased temperature sufficient to minimize precipitation of water vapor from the compressed air moving through the outside conduit portion to thereby minimize freezing in the compressed air conduit including the outside conduit portion prior to the compressed air being delivered to the nucleator of the snow making machine to there mix with the water and form the spray of ice crystal nuclei and wherein the heater body is associated with the outside conduit portion at an upstream position with respect to the machine housing Such that the freezing in the compressed air conduit including the outside conduit portion is prevented due to the increased temperature of the compressed air heated while moving through the heater body and not from the application of heat energy directed to the nucleator of the snow making machine by conduction of said heat energy through the compressed air conduit itself.

26. The machine for making artificial snow of claim 25 wherein the compressed air conduit is in fluid flow communication with a compressed air source comprising a compressed air hydrant and wherein the compressed air conduit is a thermally conductive material so that a portion of the heat energy generated by the heat-energy generator is conducted to the compressed air hydrant to help minimize precipitation of water vapor from the compressed air moving from the source and through the compressed air hydrant and thereby minimize freezing.

27. The machine for making artificial snow of claim 25 wherein the heater body has a plurality of compressed air passages fed by the compressed air conduit and leading to the nucleator, and wherein the heat-energy generator is disposed at an intermediate position between at least two of the compressed air passages and segregated therefrom.

28. The machine for making artificial snow of claim 25 wherein there are a plurality of compressed air passages, each having a first longitudinal axis, and wherein the compressed air passages are disposed in columns in the heater body with the first longitudinal axes in each column aligned along a plane, there being at least two columns of compressed air passages with the planes of the first longitudinal axes in each column being coplanar.

29. The machine for making artificial snow of claim 28 wherein the opening that receives the heat energy generator extends along a second longitudinal axis aligned normal to the plane of the columns of compressed air passages.

30. The machine for making artificial snow of claim 28 wherein the plurality of compressed air passages are aligned in three columns and wherein there are a plurality of openings that receive heat-energy generators aligned in at least two second columns, each second column disposed intermediate the columns of the compressed air passages.

* * * * *